US005078264A

United States Patent [19]

Garganese

[11] Patent Number: 5,078,264

[45] Date of Patent: Jan. 7, 1992

[54] JEWELRY DISPLAY CARD

[76] Inventor: Richard S. Garganese, P.O. Box Box 323, East Greenwich, R.I. 02818

[21] Appl. No.: 667,865

[22] Filed: Mar. 12, 1991

[51] Int. Cl.[5] ..... A45G 11/16; B65D 73/00

[52] U.S. Cl. ..... 206/6.1; 206/489

[58] Field of Search ..... 206/486–489, 206/6.1, 566

[56] References Cited

U.S. PATENT DOCUMENTS

| | | | |
|---|---|---|---|
| 1,890,181 | 12/1932 | Hoffman | 206/489 X |
| 4,099,611 | 7/1978 | Feibelman | 206/487 X |
| 4,281,469 | 8/1981 | Feibelman | 206/566 X |
| 4,687,103 | 8/1987 | Corbett | 206/489 X |
| 4,697,705 | 10/1987 | Garganese | 206/488 |
| 4,718,554 | 1/1988 | Barbato | 206/477 X |
| 4,821,883 | 4/1989 | Miller | 206/486 X |
| 4,880,117 | 11/1989 | Garganese | 206/489 X |
| 4,944,389 | 7/1990 | Robertson | 206/6.1 |
| 4,958,727 | 9/1990 | Bergeron | 206/489 X |

*Primary Examiner*—William I. Price

*Attorney, Agent, or Firm*—Barlow & Barlow, Ltd.

[57] ABSTRACT

Apparatus for displaying ear rings for use with pierced ears, including a front panel on which an ear ring ornament appears and a locking panel located at the rear of the front panel for holding a clutch in place.

10 Claims, 1 Drawing Sheet

JEWELRY DISPLAY CARD

BACKGROUND OF INVENTION

In connection with the retail sale of jewelry, a particular problem arises when the jewelry to be sold consists of small elements. For instance, in the case of ear rings, the assemblage and the parts are sometimes quite small. When the ear ring is of the type that is used with pierced ears, the ornament portion is usually provided with a stem which is intended to pass through the ear lobe and a clutch that mounts on the stem at the rear of the lobe. Since the ear rings are normally sold in pairs, there are several problems that arise. First of all, the jewelry must be displayed at the point of sale, so that the display package must be attractive. Secondly, the display package must be simple and rugged to withstand the ordeal of handling by the prospective customers, as well as during shipping, storage, and arrangement by the retailer.

A common method of displaying ear rings at the point-of-sale is by mounting them on a card that is then suspended on a rack; the mounting on the card takes place by using the stem and clutch in the manner shown in the patent of Feibelman U.S. Pat. No. 4,281,469 and the patent of Barbato U.S. Pat. No. 4,718,554 and Robertson U.S. Pat. No. 4,944,389. Another method of mounting the stem-type ear rings is by driving the stem into a soft body of material and enclosing the clutches in a separate cell, as shown in the patent to Garganese U.S. Pat. No. 4,697,705.

When any of these constructions are used in connection with the display of stem-type ear rings, a particular problem arises, particularly in the case of inexpensive jewelry; the assembly of the display packages in the factory involves considerable hand labor to assemble first the stem with the ornament on the display card and then placing the small clutch on the stem. This is not only a tedious operation, but it adds considerable expense to the unit because of the labor cost. Some of the constructions, furthermore, are less than secure and are likely to result in loss during shipment, storage, and handling. It is particularly important that the clutches do not become separated from the ornament and stem. Other constructions are less than attractive for display in the jewelry store.

These and other difficulties experienced with the prior art devices have been obviated in a novel manner by the present invention.

It is, therefore, an outstanding object of the invention to provide a display card for demonstrating jewelry having stems and pins in an attractive manner.

Another object of this invention is the provision of a display card for ear rings for pierced ears, in which the ornament and stem do not become separated from the clutches.

A further object of the present invention is the provision of a display card in which the clutches are secured in a manner, such that they cannot be removed without destroying the package.

A still further object of the invention is the provision of a display card which is simple and rugged in construction, which is easy to manufacture from readily-obtainable materials, and which is capable of a long life of service with a minimum of care.

It is a further object of the invention to provide a display card in which assembly with stem-type jewelry involves very little manual labor.

With these and other objects in view, as will be apparent to those skilled in the art, the invention resides in the combination of parts set forth in the specification and covered by the claims appended hereto.

SUMMARY OF THE INVENTION

In general, the invention consists of a display card for use with an ear ring having an integral stem and a separate clutch, which has a main panel with a front face surface on which the ornament appears. The stem extends through an aperture in the panel and a clutch is mounted on the stem against the rear surface of the panel. A locking sheet is pressed against major portions of the rear surface and serves to press the shield element against the rear surface, while the stem extends through the sheet.

More specifically, the clutch may consist of a peripheral shield, or other integral enlarged surface. The shield generally consists of a clear polymer disk with a central aperture that engages the clutch body. In one version of the invention, the locking sheet is folded over the back surface of the main panel and cemented to it. In another version the locking sheet is a thin, clear polymer sheet that is shrink-wrap applied to the main panel and in a further version the locking sheet is a flocked sheet cemented to the main panel.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
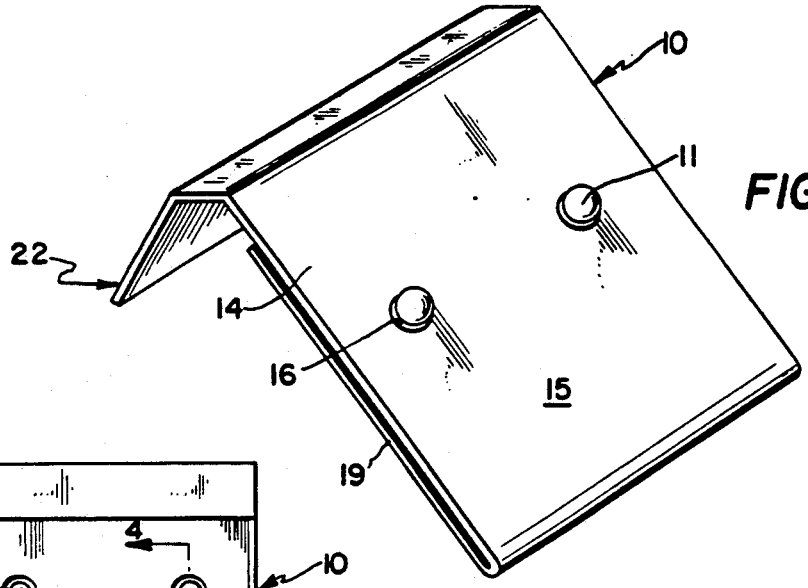
FIG. 1 is a perspective view of a display card incorporating the principles of the present invention.
Figure 2:
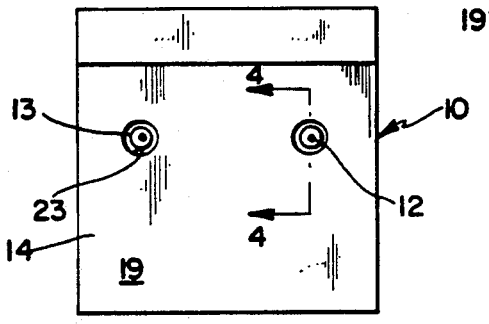
FIG. 2 is a front elevational view of the display card.
Figure 3:
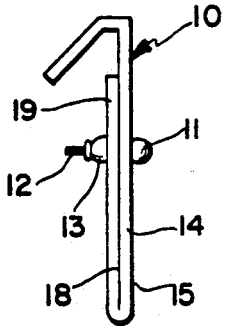
FIG. 3 is a side elevational view of the display card.

Referring first to FIGS. 1-3, which best show the general features of the invention, the display card, indicated generally by the reference numeral 10, is shown in use with an ear ring 11 having an integral stem 12 and a separate clutch 13. A main panel 14 is provided with a front face surface 15 on which the ornament appears. The stem 12 extends through an aperture 16 in the main panel 14 and an enlarged surface in the form of a shield element 17, forming part of the clutch, lies against the rear surface 18 of the panel.

A locking sheet 19 lies against the major portions of the rear surface and serves to press the shield element 17 portion of the clutch against the rear surface 18. The main panel 14 is provided at its upper edge with a hook portion 22 to facilitate suspension from a display rack.

The locking sheet 19 consists of an integral extension of the main panel 14 that is folded back to lie against the rear surface 18 and to be cemented to it. The locking sheet is provided with an aperture 23 through which the clutch and stem protrude.

The two apertures 16 in the main panel are congruent with the two apertures 23 in the locking sheet. Furthermore, the shield element 17, which is in the form of a disk, is larger than either of the apertures. The aperture 16 in the main panel is sufficiently large so that the face of the clutch is exposed, while the aperture 23 in the locking sheet is larger than the clutch. Both the ornament and the clutch extend from their respective apertures, while being held in place by the shield which is clamped between the main panel and the locking sheet.

The operation and advantages of the invention will now be readily understood in view of the above description. To begin with, the display card 10 is assembled during manufacture by placing the clutches in the apertures 23. With the main panel 14 in a horizontal position, the locking sheet 19 (which has been supplied with a coating of cement) is folded against the rear surface 18 of the panel. When this has been done, a portion of the clutch 13 protrudes through the apertures 23 in the sheet. The shield element 17 is, therefore, locked between the main panel and the locking sheet. In most cases, the shield is firmly fixed to the clutch, so that the clutch cannot be removed without destroying the assemblage. In other words, the clutches are not available for use until after the sale, at which time the locking sheet 19 is peeled from the back of the main panel. The completed card with the clutches can now be delivered to carding assembly where the ear ring stem is pressed into the clutch with the ornament resting on the main panel (to produce a completed display) which is accomplished with very little manual labor as it is not necessary to create the second movement of mounting a clutch on a stem while holding the card and ornament. The cost of labor is substantially reduced.

Figure 4:
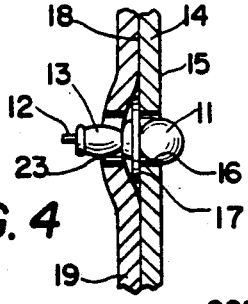
FIG. 4 is a sectional view of the invention taken on the line 4—4 of FIG. 2.
Figure 5:
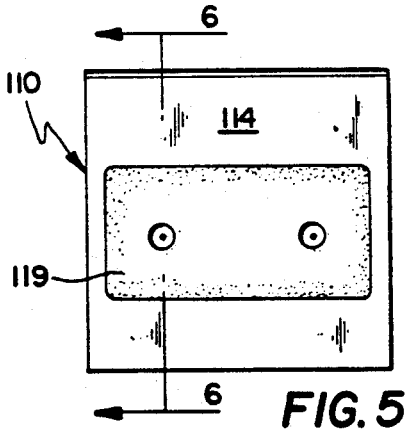
FIG. 5 is a front elevational view of a modification of the invention.
Figure 6:
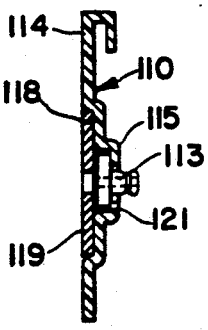
FIG. 6 is a sectional view of the invention taken on the line 6—6 of FIG. 5.

FIGS. 5 and 6 show a modification of the invention in which the display card 110 is shown with a flocked insert 119. The main panel 114 has a front face surface with a recess that is formed therein and into which the insert 119 may be received. The clutches 113 have a shield or enlarged end wall 121 and are received in slight depressions in the recess and are retained therein by the insert 119 which is secured to the main panel 114 as by an adhesive (similar to that shown in FIG. 4). Flocked sheet 119 overlies the clutches which are held in place against the rear surface 118 of the main panel 114.

In this form of the invention, the main panel is preferably made from a polymer that can be easily thermoformed, while the flocked insert may be any base material onto which flock may adhere.

Figure 7:
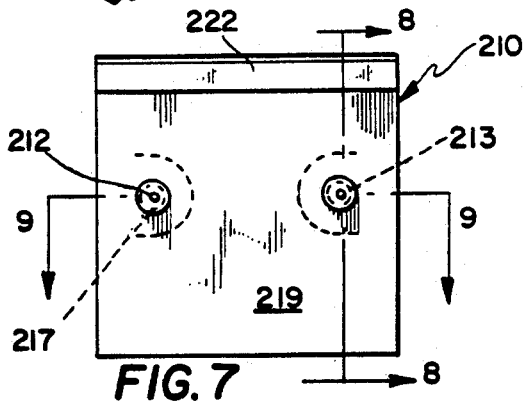
FIG. 7 is a rear elevational view of another modified form of the invention.
Figure 8:
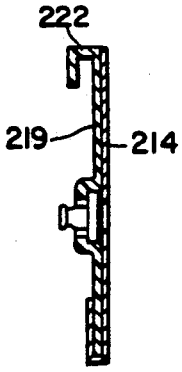
FIG. 8 is a sectional view taken on line 8—8 of FIG. 7.
Figure 9:
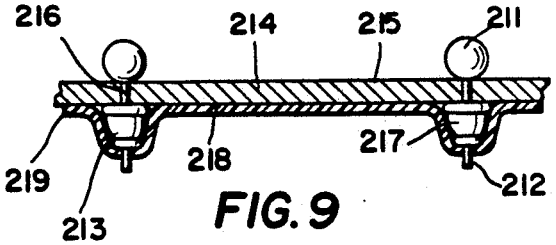
FIG. 9 is a sectional view of the invention, taken on the line 9—9 of FIG. 7.

FIGS. 7 and 8 show another form of the invention in which the display card 210 is used with a pair of ear rings 211, each of which has a stem 212 and a clutch 213. The front face surface 215 of a main panel 214 is formed of relatively heavy paper stock and is pierced as at 216 to permit the stems of the ear ring to pass through. The clutches 213 which have shield elements or enlarged surfaces 217 are pressed against the rear surface 218 of the main panel at the piercings and are held in place by a locking sheet 219, which is in the form of a thin, clear film of a polymer. The locking sheet may be applied by using the shrink wrap method and is sucked tightly into contact with the rear surface, while being pulled tightly over the clutches 213. When the stems of the earrings are inserted, they will pierce the sheet. The upper edge of the main panel is provided with a hook portion 222 that permits the display card to be suspended from a display rack in a store.

In this form of the invention, a semi-circular cut which is concentric with the axis of the clutch 213 may be made through the main panel and the locking sheet to provide a hinged portion to accept hoop earrings that are displayed on the front face of the card. It will be appreciated that the hinged portions will contain the clutches that are secured in place by the locking sheet.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Display card for use with an ear ring including an ornament with an integral stem and a separate clutch, comprising (a) a main panel having a front face surface on which the ring ornament appears, the stem extending through an aperture in the panel, (b) the clutch having an enlarged surface lying against the rear surface of the panel, and (c) a locking sheet lying against the major portion of the rear surface and serving to press the enlarged surface of the clutch against the rear surface, while the stem extends through the locking sheet.

2. Display card as recited in claim 1, wherein the enlarged surface is a shield that lies between the body of the clutch and the rear surface of the panel.

3. Display card as recited in claim 1, wherein the locking sheet is a thin film of polymer laminated to the card by the shrink wrap method.

4. Display card as recited in claim 3, wherein the stem pierces the locking sheet

5. Display card as recited in claim 1, wherein the locking sheet is a semi-rigid polymer film.

6. Display card for use with an ear ornament having an integral stem and a separate clutch, comprising (a) a panel having a front face on which the ornament appears, the stem extending through an aperture in the card, (b) a shield adapted to be associated with the clutch, the shield having a central aperture by which it is impaled on the stem, and (c) a locking sheet pressed against portions of the rear surface of the panel, while holding the shield against the rear surface.

7. Display card as recited in claim 6, wherein the said locking sheet is provided with a recess to receive the shield portion of the clutch.

8. Display card as recited in claim 6, wherein the clutch and the shield are integral.

9. Display card as recited in claim 6, wherein the panel and locking sheet are provided with a semi-circular cut to provide a hinged portion on which the aperture on the card is located, the hinged portion being capable of being moved out of the plane of the remainder of the panel in order to receive a hoop-type ear ornament.

10. Display card for use with ear ornaments, each having a stem and a clutch mounted on the stem, comprising (a) a front panel adapted to be suspended from a display rack, (b) a protective shield adapted to be associated with the clutch and having a central aperture through which the stem passes into the clutch, and (c) a locking panel lying along the rear surface of the front card and fastened thereto, wherein the shield is sandwiched between the front panel and the locking panel, wherein the two panels are formed with apertures which are generally congruent, the shield being larger than either aperture, the clutch being held in place by the clamping of the shield between the panels.

* * * * *